US009290340B2

(12) United States Patent
Yamamoto

(10) Patent No.: US 9,290,340 B2
(45) Date of Patent: Mar. 22, 2016

(54) SHEET CONVEYING APPARATUS AND IMAGE FORMING APPARATUS PROVIDED WITH SAME

(71) Applicant: KYOCERA Document Solutions Inc., Osaka-shi, Osaka (JP)

(72) Inventor: Kiyonori Yamamoto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/692,139

(22) Filed: Apr. 21, 2015

(65) Prior Publication Data

US 2015/0309460 A1 Oct. 29, 2015

(30) Foreign Application Priority Data

Apr. 24, 2014 (JP) ..... 2014-089992

(51) Int. Cl.

*B65H 5/38* (2006.01)
*B65H 1/26* (2006.01)
*G03G 15/00* (2006.01)

(52) U.S. Cl.

CPC ..... *B65H 1/266* (2013.01); *B65H 5/38* (2013.01); *G03G 15/6511* (2013.01); *B65H 2402/64* (2013.01); *B65H 2404/611* (2013.01); *G03G 2215/00383* (2013.01); *G03G 2215/00396* (2013.01)

(58) Field of Classification Search

CPC .... B65H 5/38; B65H 1/266; B65H 2404/611; B65H 2402/64; B65H 5/36; B65H 3/66; B65H 2404/693; B65H 2405/31; G03G 15/6514; G03G 15/6511; G03G 2215/00396; G03G 2215/00383

See application file for complete search history.

(56) References Cited

U.S. PATENT DOCUMENTS

2004/0041334 A1* 3/2004 Yoshihara ..... B65H 1/04 271/145
2009/0309288 A1* 12/2009 Daigo ..... B65H 1/266 271/3.14
2013/0221612 A1* 8/2013 Harada ..... B65H 5/062 271/272
2014/0210159 A1* 7/2014 Kobayashi ..... B65H 5/062 271/226
2014/0353908 A1* 12/2014 Kobayashi ..... B65H 9/00 271/226

FOREIGN PATENT DOCUMENTS

JP 2001-301993 10/2001

* cited by examiner

*Primary Examiner* — David H Bollinger
(74) *Attorney, Agent, or Firm* — Gerald E. Hespos; Michael J. Porco; Matthew T. Hespos

(57) ABSTRACT

A sheet conveying apparatus includes an apparatus main body, a sheet cassette, a mounting portion and a conveying unit. The sheet cassette is mounted into the apparatus main body. The conveying unit is arranged above the sheet cassette in the apparatus main body. The conveying unit includes a conveyance path, an upper guide unit, a lower guide unit and a locking mechanism. The upper guide unit defines an upper surface part of the conveyance path. The lower guide unit defines a lower surface part of the conveyance path and enters the mounting portion to open the conveyance path. The locking mechanism locks the lower guide unit to the upper guide unit. The lower guide unit includes a projecting piece. The sheet cassette includes a push-up portion. The push-up portion pushes up the projecting piece when the sheet cassette is mounted into the mounting portion.

9 Claims, 12 Drawing Sheets

SHEET CONVEYING APPARATUS AND IMAGE FORMING APPARATUS PROVIDED WITH SAME

INCORPORATION BY REFERENCE

This application is based on Japanese Patent Application No. 2014-089992 filed with the Japan Patent Office on Apr. 24, 2014, the contents of which are hereby incorporated by reference.

BACKGROUND

The present disclosure relates to a sheet conveying apparatus with a sheet cassette for storing sheets inside and an image forming apparatus provided with the same.

Conventionally, there is known a sheet conveying apparatus with a sheet cassette configured to store sheets inside and detachably mounted into an apparatus main body of an image forming apparatus. In this sheet conveying apparatus, a separation roller for conveying a sheet is pushed up and positioned as the sheet cassette is inserted into the apparatus main body.

Further, there is known an image forming apparatus with a double-sided conveying unit for conveying a sheet toward an image forming unit to form an image on the other side of the sheet having an image formed on one side.

SUMMARY

A sheet conveying apparatus according to one aspect of the present disclosure includes an apparatus main body, a sheet cassette, a mounting portion and a conveying unit. The sheet cassette includes a storage for storing sheets inside and is mounted into the apparatus main body in a predetermined mounting direction. The mounting portion is arranged in the apparatus main body and the sheet cassette is mounted thereinto. The conveying unit is arranged above the sheet cassette in the apparatus main body and conveys the sheet. The conveying unit includes a conveyance path in which the sheet is conveyed, an upper guide unit, a lower guide unit and a locking mechanism. The upper guide unit defines an upper surface part of the conveyance path and is fixed to the apparatus main body. The lower guide unit defines a lower surface part of the conveyance path and enters the mounting portion to open the conveyance path by downward rotation of an upstream side in the mounting direction about a rotation supporting point arranged on a downstream side in the mounting direction. The locking mechanism is arranged on one end side of the upstream side of the conveying unit in the mounting direction in a sheet width direction intersecting with the mounting direction and locks the lower guide unit to the upper guide unit. The lower guide unit includes a projecting piece. The projecting piece projects toward the upstream side in the mounting direction. The locking mechanism is disposed closer to the one side than the projecting piece in the sheet width direction. The sheet cassette includes a push-up portion. The push-up portion pushes up the projecting piece when the sheet cassette is mounted into the mounting portion.

Further, an image forming apparatus according to another aspect of the present disclosure includes the above sheet conveying apparatus and an image forming unit. The image forming unit is arranged in the apparatus main body and forms an image on a sheet.

DETAILED DESCRIPTION

Figure 1:
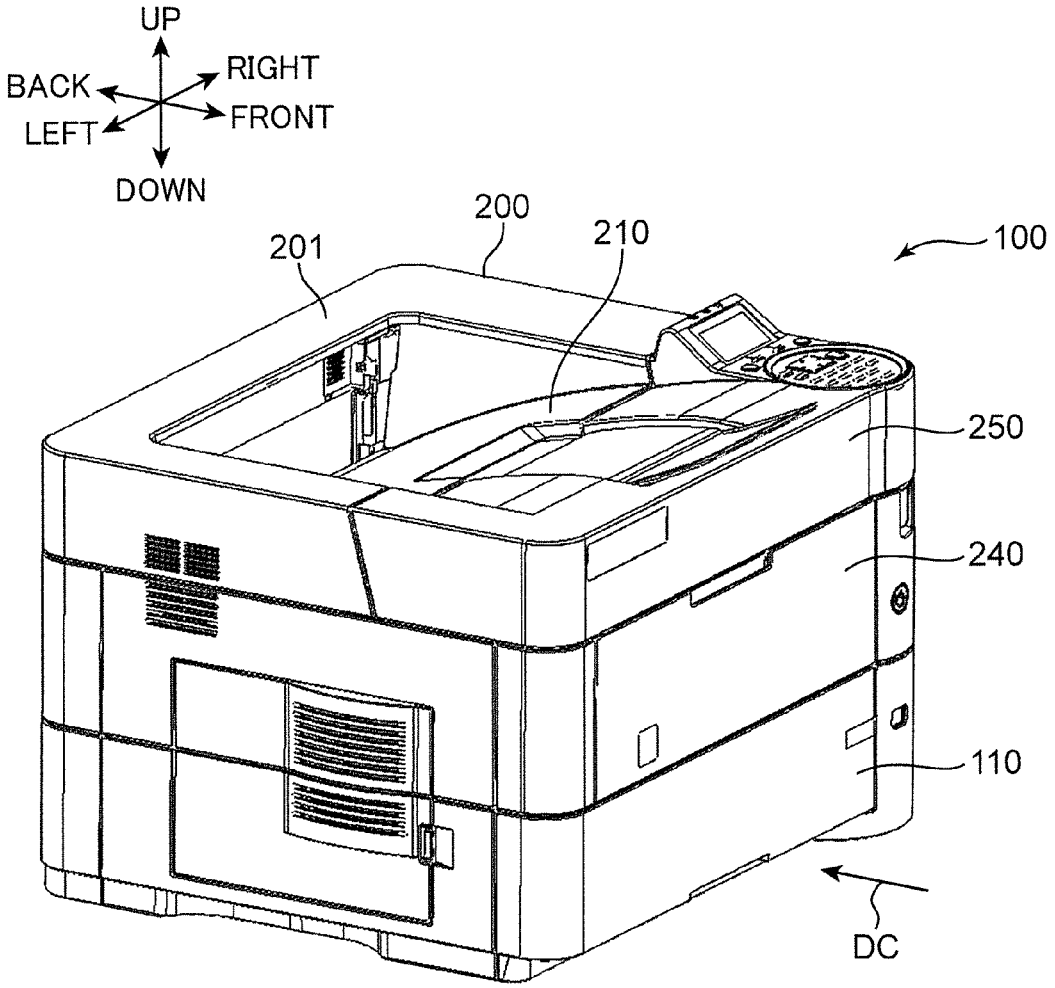
FIG. 1 is a perspective view showing an image forming apparatus according to one embodiment of the present disclosure.
Figure 2:
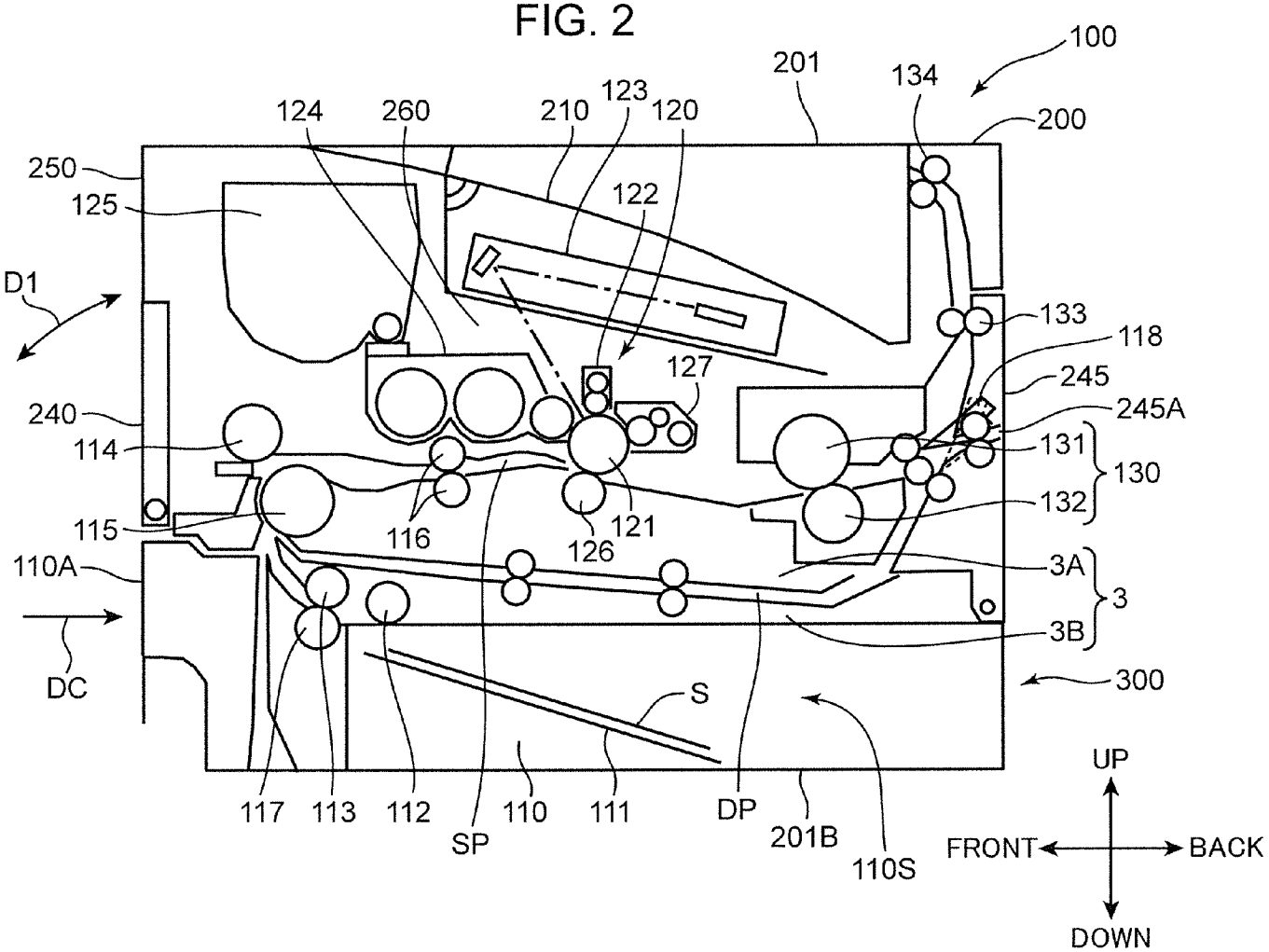
FIG. 2 is a schematic sectional view showing the internal configuration of the image forming apparatus according to the one embodiment of the present disclosure.

Hereinafter, one embodiment of the present disclosure is described with reference to the drawings. FIG. 1 is a perspective view of a printer 100 (image forming apparatus) according to one embodiment of the present disclosure. FIG. 2 is a sectional view schematically showing the internal configuration of the printer 100 shown in FIG. 1. The image forming apparatus may be a color printer, a facsimile machine, a complex machine provided with these functions or another apparatus for forming a toner image on a sheet. Note that direction-indicating terms such as "upper" and "lower", "front" and "back", "left" and "right" used in the following description are merely for the purpose of clarifying the description and do not limit the principle of the image forming apparatus at all.

The printer 100 includes a housing 200 (apparatus main body) for housing various devices for forming an image on a sheet. The housing 200 includes an upper wall 201 defining the upper surface of the housing 200, a bottom wall 201B (FIG. 2) defining the bottom surface of the housing 200, a main body rear wall 245 (FIG. 2) between the upper wall 201 and the bottom wall 201B and a main body front wall 250 located before the main body rear wall 245. The housing 200 includes a main body internal space 260 in which various devices are arranged. A sheet conveyance path SP in which the sheet S is conveyed in a predetermined conveying direction extends in the main body internal space 260 of the housing 200.

A sheet discharging portion 210 is arranged in a central part of the upper wall 201. The sheet discharging portion 210 is formed by an inclined surface inclined downwardly from a front part to a rear part of the upper wall 201. The sheet having an image formed thereon in an image forming unit 120 to be described later is discharged to the sheet discharging portion 210. Further, a manual feed tray 240 is arranged in a central part of the main body front wall 250. The manual feed tray 240 is vertically rotatable with a lower end as a supporting point (arrow Dl of FIG. 2).

With reference to FIG. 2, the printer 100 includes a sheet cassette 110, a pickup roller 112, a feed roller 113, a retard roller 117, a manual feed roller 114, a conveyor roller 115, a pair of registration rollers 116, the image forming unit 120 and a fixing device 130.

The sheet cassette 110 includes a sheet storage 110S (storage) and a lift plate 111 inside. The sheet storage 110S is a space for storing sheets S. The lift plate 111 is inclined to push up leading edges of the sheets S. The sheet cassette 110 can be pulled out forward from the housing 200 and is mounted backward (mounting direction, arrow DC of FIGS. 1 and 2) into the housing 200.

The pickup roller 112 is arranged above the leading edges of the sheets S pushed up by the lift plate 111. The feed roller 113 is arranged downstream of the pickup roller 112 and feeds the sheet S to a further downstream side. The retard roller 117 is arranged to face the feed roller 113 and has a function of separating a plurality of sheets S. The manual feed roller 114 is arranged at an inner side (rear side) of the manual feed tray 240 and pulls a sheet S on the manual feed tray 240 into the housing 200. The conveyor roller 115 conveys the sheet S fed by the feed roller 113 toward the image forming unit 120 on a further downstream side.

The pair of registration rollers 116 have a function of correcting oblique feed of the sheet S. In this way, the position of an image to be formed on the sheet S is adjusted. The pair of registration rollers 116 supply the sheet S to the image forming unit 120 in accordance with an image formation timing by the image forming unit 120.

The image forming unit 120 is arranged in the housing 200 and forms an image on the sheet S. The image forming unit 120 includes a photoconductive drum 121, a charger 122, an exposure device 123, a developing device 124, a toner container 125, a transfer roller 126 and a cleaning device 127.

The fixing device 130 is arranged downstream of the image forming unit 120 in the conveying direction and fixes a toner image on the sheet S. The fixing device 130 includes a heating roller 131 for melting toner on the sheet S and a pressure roller 132 for bringing the sheet S into close contact with the heating roller 131.

The printer 100 further includes a pair of conveyor rollers 133 arranged downstream of the fixing device 130 and a pair of discharge rollers 134 arranged downstream of the pair of conveyor rollers 133. The sheet S is conveyed upwardly by the pair of conveyor rollers 133 and finally discharged from the housing 200 by the pair of discharge rollers 134. Sheets S discharged from the housing 200 are stacked on the sheet discharging portion 210.

Further, the printer 100 includes a switching guide 118, a reversing/discharging port 245A and a double-sided conveying unit 3 (conveying unit) 3 (FIG. 2).

The switching guide 118 is a guide member for switching the conveying direction of the sheet S by being rotated by an unillustrated driving mechanism. The switching guide 118 is arranged in a part of the sheet conveyance path SP behind the fixing device 130. The reversing/discharging port 245A is a slit-like opening formed on the main body rear wall 245. When a tip part of the switching guide 118 is arranged on an upper side as shown in FIG. 2, a leading end part of the sheet S discharged from the fixing device 130 is temporarily exposed to the outside of the housing 200 through the reversing/discharging port 245A. Thereafter, the sheet S is carried into a double-sided conveyance path DP of the double-sided conveying unit 3 by rotating a pair of conveyor rollers arranged near the switching guide 118 in a reverse direction by an unillustrated controller. On the other hand, when the tip part of the switching guide 118 is arranged to be lower than in the state shown in FIG. 2, the sheet S discharged from the fixing device 130 is guided toward the pair of conveyor rollers 133 and the pair of discharge rollers 134.

The double-sided conveying unit 3 is a unit arranged above the sheet cassette 110 in the housing 200. The double-sided conveying unit 3 conveys the sheet S guided by the switching guide 118 from the rear side toward the front side. Note that although the direction of conveying the sheet S by the double-sided conveying unit 3 is a direction opposite to a mounting direction of the sheet cassette 110 in this embodiment, the direction of conveying sheet S by the double-sided conveying unit 3 (conveying unit) may be the same as the mounting direction of the sheet cassette 110 in another embodiment.

The double-sided conveying unit 3 conveys the sheet S having a toner image fixed on one side in the fixing device 130 toward the image forming unit 120 again. With reference to FIG. 2, the sheet S conveyed forward by the double-sided conveying unit 3 is conveyed toward the pair of registration rollers 116 by the conveyor roller 115. After a toner image is formed on the other side of the sheet S and a fixing process is applied, the sheet S is discharged to the sheet discharging portion 210. Note that a sheet conveying apparatus 300 in this embodiment is configured by the housing 200, the sheet cassette 110 and the double-sided conveying unit 3 described above.

Figure 3:
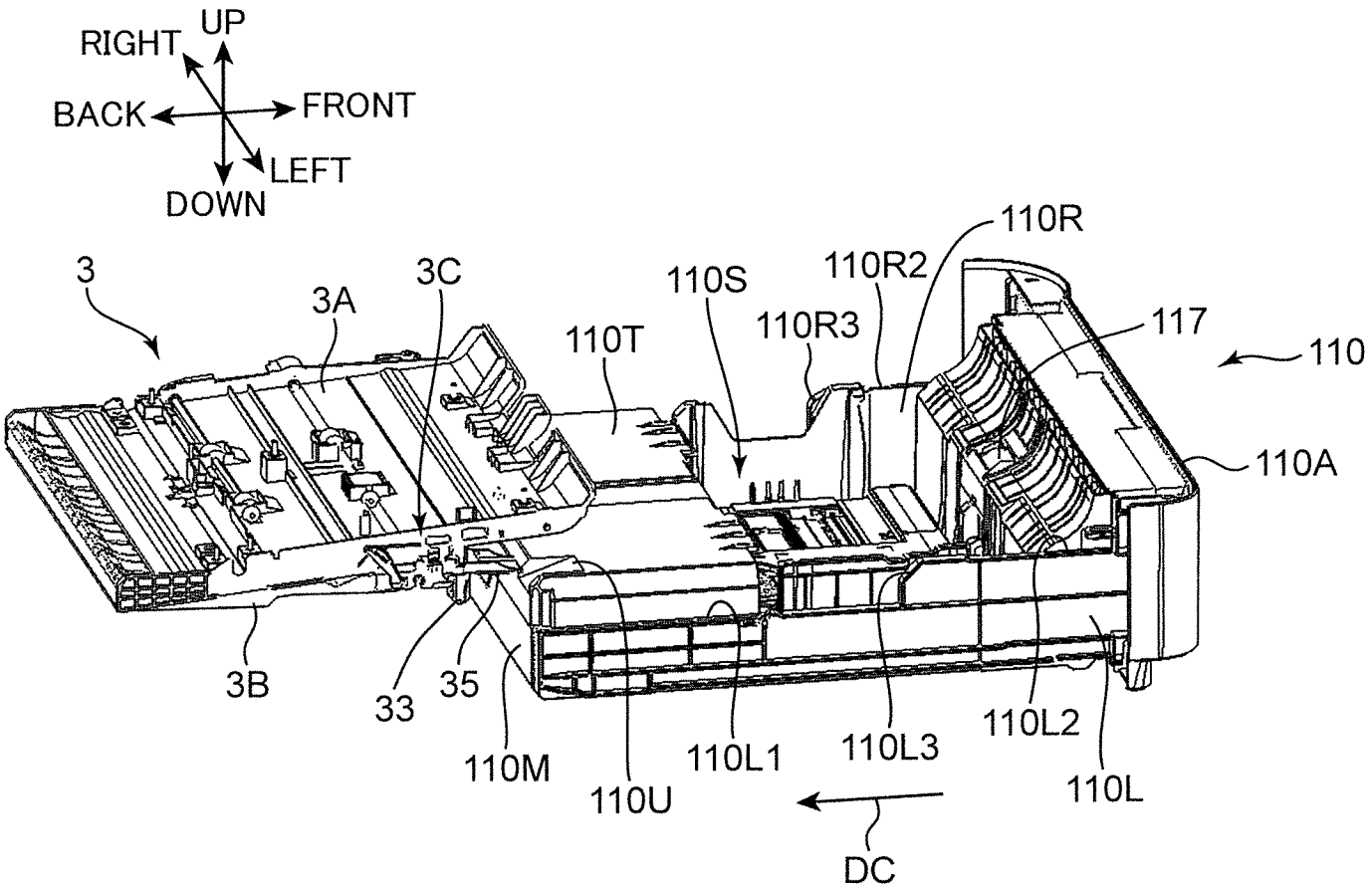
FIG. 3 is a perspective view of a sheet cassette and a conveying unit according to the one embodiment of the present disclosure.
Figure 4:
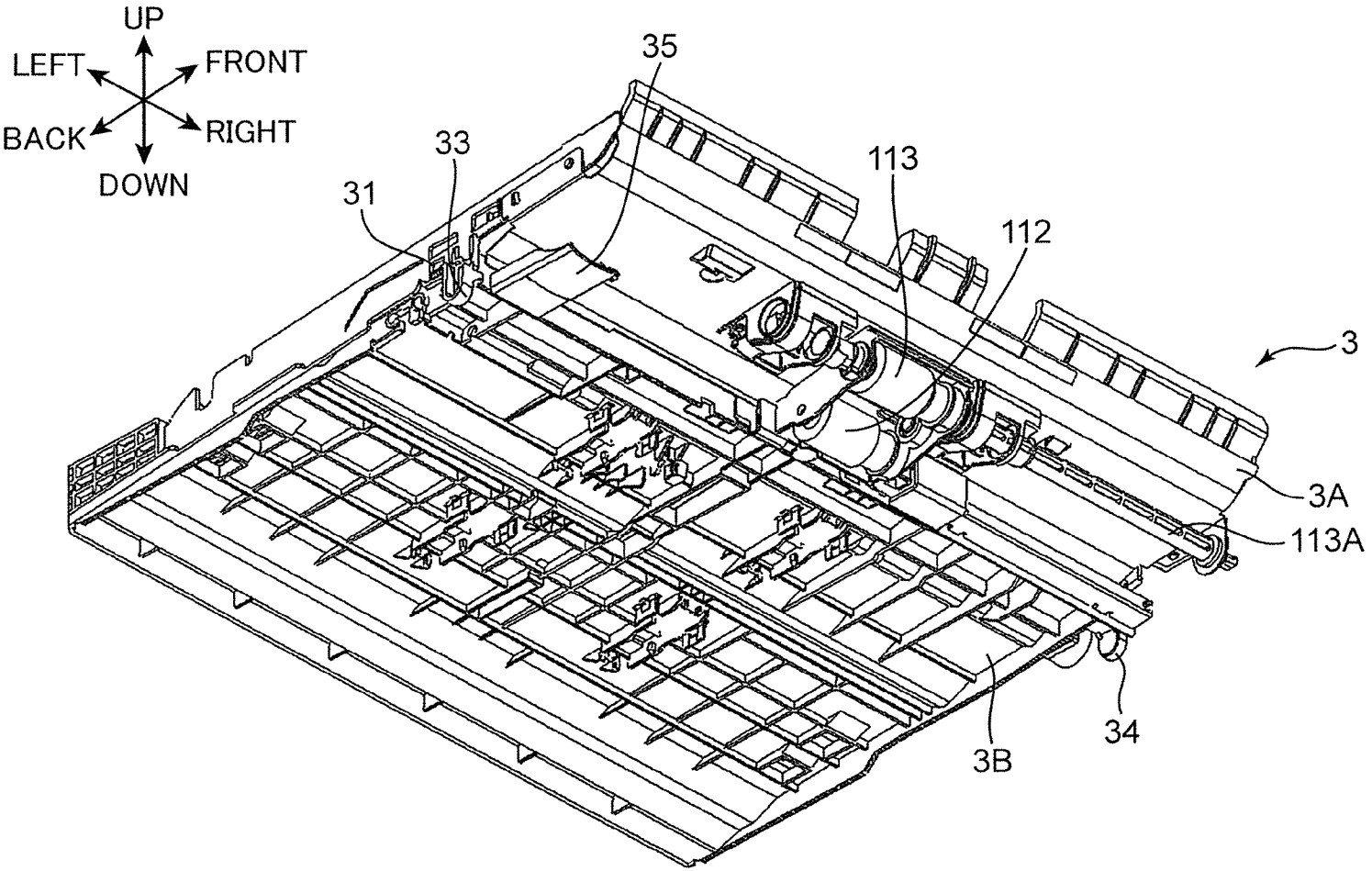
FIG. 4 is a perspective view of the conveying unit according to the one embodiment of the present disclosure.
Figure 5:
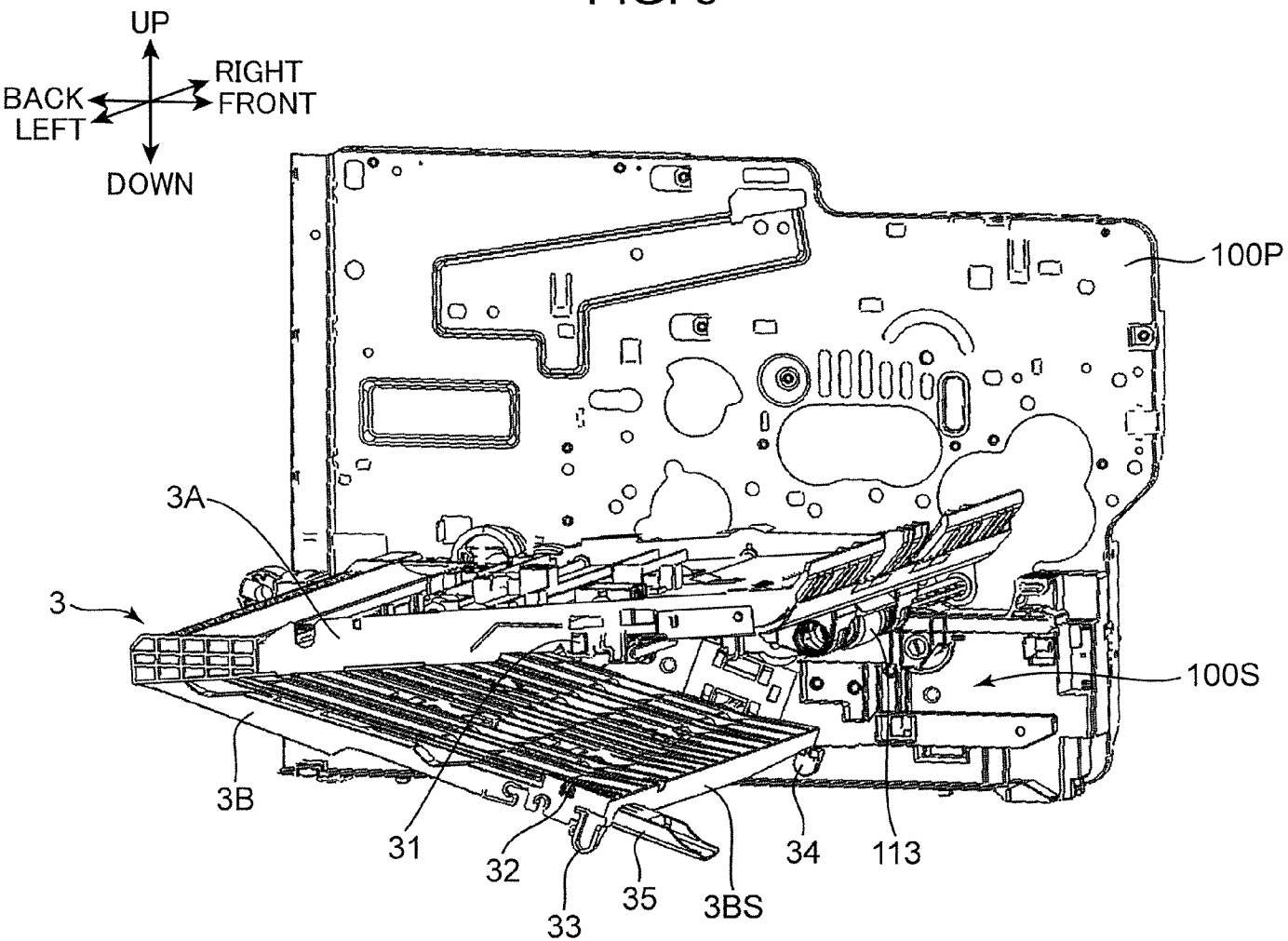
FIG. 5 is a perspective view showing a state where a lower guide unit of the conveying unit according to the one embodiment of the present disclosure is opened.
Figure 6:
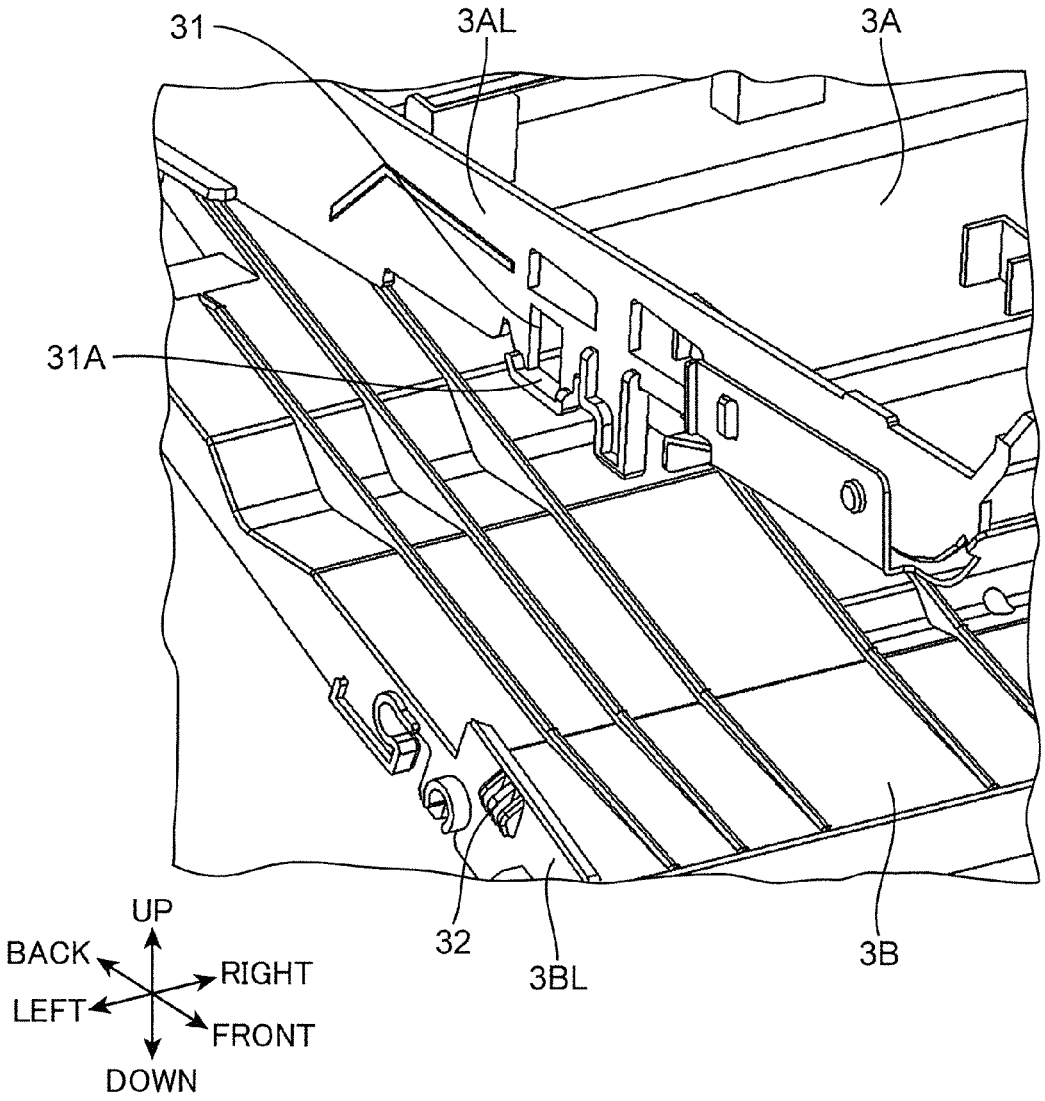
FIG. 6 is an enlarged perspective view showing the state where the lower guide unit of the conveying unit according to the one embodiment of the present disclosure is opened.
Figure 7:
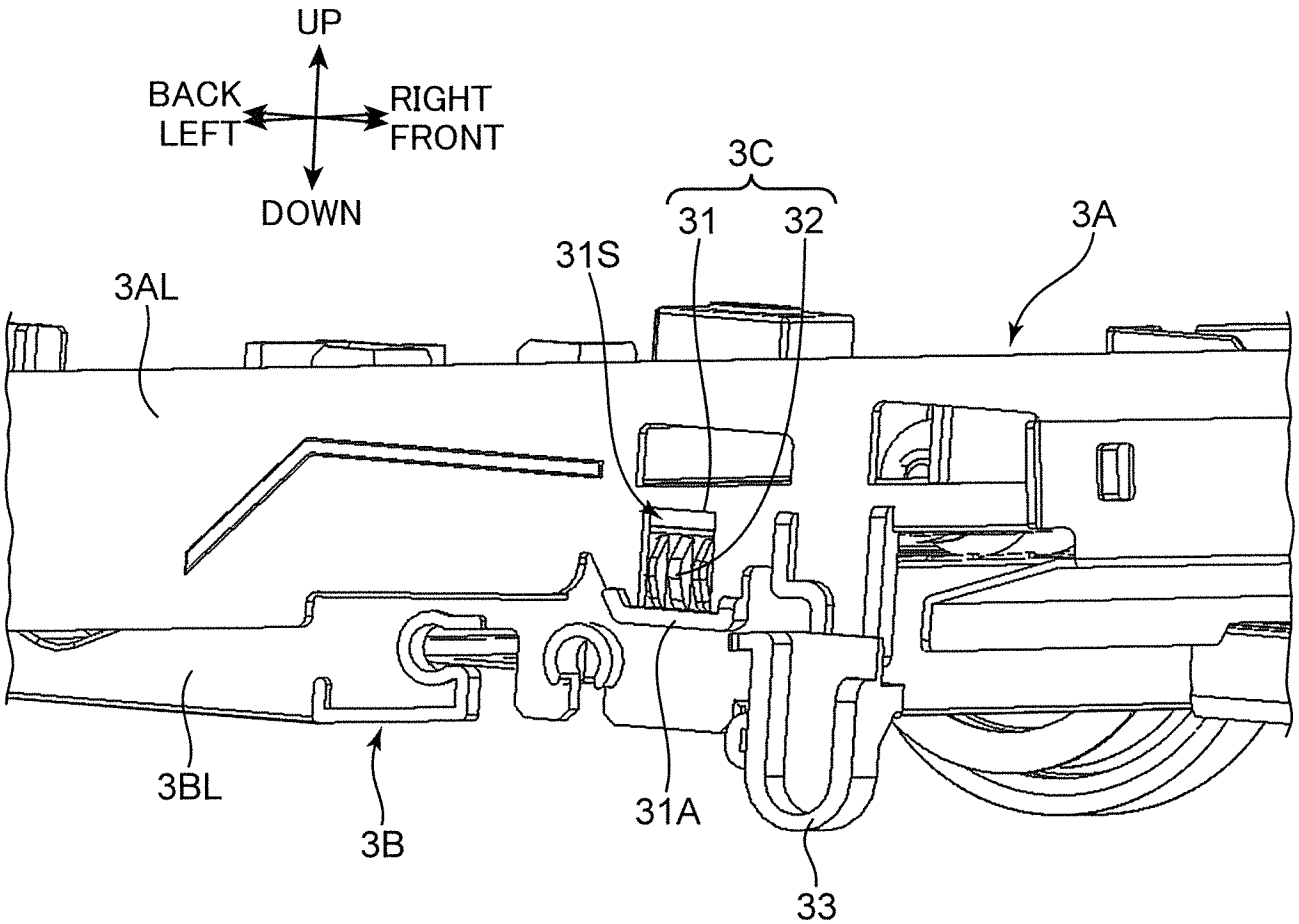
FIG. 7 is an enlarged perspective view showing a state where the lower guide unit of the conveying unit according to the one embodiment of the present disclosure is closed.

Next, the structures of the sheet cassette 110 and the double-sided conveying unit 3 according to a first embodiment of the present disclosure are further described in detail with reference to FIGS. 3 to 7. FIG. 3 is a perspective view of the sheet cassette 110 and the double-sided conveying unit 3 according to this embodiment. FIG. 4 is a perspective view of the double-sided conveying unit 3. FIG. 5 is a perspective view showing a state where a lower guide unit 3B of the double-sided conveying unit 3 is opened. FIG. 6 is an enlarged perspective view showing the state where the lower guide unit 3B of the double-sided conveying unit 3 is opened. FIG. 7 is an enlarged perspective view showing a state where the lower guide unit 3B of the double-sided conveying unit 3 is closed.

With reference to FIG. 5, the printer 100 includes a main body right wall portion 100P. The main body right wall portion 100P is a part of a frame constituting the housing 200 and a wall portion vertically standing on a right side of the housing 200. Note that an unillustrated wall portion standing in parallel to the main body right wall portion 100P is arranged also on a left side of the housing 200. The aforementioned double-sided conveying unit 3 is a flat unit fixed between a pair of these wall portions. A mounting portion 100S is formed below the double-sided conveying unit 3 in the housing 200 (FIG. 5). The mounting portion 100S is a space into which the sheet cassette 100 is mounted.

With reference to FIG. 3, the sheet cassette 110 includes a cassette front wall 110A, a cassette rear wall 110M, a cassette left wall 110L (side wall), a cassette right wall 110R (side wall) and a cassette ceiling plate 11 OT (ceiling plate). The cassette front wall 11 OA is a wall portion on a front side (upstream side in the mounting direction) of the sheet cassette 110. The cassette rear wall 110M is a wall portion on a rear side (downstream side in the mounting direction) of the sheet cassette 110. When the sheet cassette 110 is mounted into the housing 200, the cassette front wall 110A constitutes a part of the main body front wall 250 (FIG. 2). Further, as shown in FIG. 3, a curved conveyance guide portion is arranged at an inner side (rear side) of the cassette front wall 110A, and the aforementioned retard roller 117 is rotatably supported in a central part of the conveyance guide portion.

The cassette left wall 110L is a side wall standing on a left side of the sheet cassette 110. As shown in FIG. 3, the cassette left wall 110L has such step portions as to be lower on a downstream side than on an upstream side in the mounting direction (arrow DC of FIG. 3). Further, the cassette left wall 110L includes a first left-upper end portion 110L1, a second left-upper end portion 110L2 (positioning portion) and a left inclined portion 110L3 (inclined portion). The first left-upper end portion 110L1 is a downstream area in the mounting direction out of an upper end part of the cassette left wall 110L. The second left-upper end portion 110L2 is an upstream area in the mounting direction out of the upper end part of the cassette left wall 110L and set to be higher than the first left-upper end portion 110L1. The left inclined portion 110L3 is an inclined portion formed on a downstream corner part in the mounting direction out of the second left-upper end portion 110L2. The left inclined portion 110L3 is formed to be gradually lowered along the mounting direction.

The cassette right wall 110R is a side wall standing on a right side of the sheet cassette 110. The cassette right wall 110R is shaped similarly to the cassette left wall 110L. The cassette right wall 110R includes an unillustrated first right-upper end portion, a second right-upper end portion 110R2 (positioning portion) and a right inclined portion 110R3 (inclined portion). The second right-upper end portion 110R2 and the right inclined portion 110R3 respectively correspond to the second left-upper end portion 110L2 and the left inclined portion 110L3 of the cassette left wall 110L. Note that the second left-upper end portion 110L2 and the second right-upper end portion 11082 have a function of positioning the lower guide unit 3B of the double-sided conveying unit 3 with respect to the upper guide unit 3A in a vertical direction.

The cassette ceiling plate 110T is arranged above the sheet storage 110S. In this embodiment, the cassette ceiling plate 110T covers a rear part (downstream side in the mounting direction) of the sheet storage 110S from above. The cassette ceiling plate 110T has a guide surface 110U (push-up portion, inclined surface) (FIG. 3). The guide surface 110U is formed on a downstream side of the cassette ceiling plate 110T in the mounting direction. The guide surface 110U is an inclined surface formed to be gradually lowered along the mounting direction of the sheet cassette 110. Further, the guide surface 110U is arranged to face a later-described grip portion 35 of the double-sided conveying unit 3 in the mounting direction of the sheet cassette 110. Note that the grip portion 35 comes into contact with the guide surface 110U when the sheet cassette 110 is mounted into the mounting portion 110S.

With reference to FIGS. 2 to 5, the double-sided conveying unit 3 includes the double-sided conveyance path DP (conveyance path) (FIG. 2), the upper guide unit 3A, the lower guide unit 3B and a locking mechanism 3C (FIG. 7). The double-sided conveyance path DP is a conveyance path formed in the double-sided conveying unit 3 and the sheet S is conveyed forward as described above. The upper guide unit 3A is a plate-like member fixed to the main body right wall portion 100P of the housing 200 and the like. The upper guide unit 3A defines an upper surface part of the double-sided conveyance path DP. Further, as shown in FIG. 4, the aforementioned pickup roller 112 and feed roller 113 are rotatably supported on a front side of the upper guide unit 3A. By inputting a drive force to a drive shaft 113A, which is a rotary shaft of the feed roller 113, from an unillustrated driving mechanism, the feed roller 113 rotates. Further, the pickup roller 112 rotates in synchronization with the feed roller 113 via an unillustrated transmission mechanism arranged between the feed roller 113 and the pickup roller 112. Further, the upper guide unit 3A includes an upper guide unit left wall 3AL (FIGS. 6, 7). The upper guide unit left wall 3AL is a left side wall of the upper guide unit 3A.

The lower guide unit 3B is a plate-like member arranged below the upper guide unit 3A. The lower guide unit 3B defines a lower surface part of the double-sided conveyance path DP. Further, with reference to FIG. 5, a front part (upstream side in the mounting direction of the sheet cassette 110) of the lower guide unit 3B is rotatable downward about an unillustrated rotation supporting point arranged on a rear end part of the lower guide unit 3B (downstream side in the mounting direction of the sheet cassette 110). As shown in FIG. 5, when the lower guide unit 3B is rotated downward, the front part of the lower guide unit 3B enters the mounting portion 100S to open the double-sided conveyance path DP. Further, the lower guide unit 3B includes a lower guide unit left wall 3BL (FIGS. 6, 7). The lower guide unit left wall 3BL is a left side wall of the lower guide unit 3B. The lower guide unit left wall 3BL is arranged slightly more rightward than the upper guide unit left wall 3AL. As shown in FIG. 7, when the lower guide unit 3B is closed upward, the lower guide unit left wall 3BL is arranged at an inner side of the upper guide unit left wall 3AL in a sheet width direction to be partially overlap the upper guide unit left wall 3AL. Note that wall portions similar to the lower and upper guide unit left walls 3BL, 3AL are also arranged on right end parts of the lower and upper guide units 3A, 3B. Further, a plurality of pairs of unillustrated rollers for conveying the sheet S are arranged on the upper and lower guide units 3A, 3B.

With reference to FIGS. 6 and 7, the locking mechanism 3C is arranged on an upstream side of a left end part (one end part in the sheet width direction intersecting with the mounting direction of the sheet cassette 110) of the double-sided conveying unit 3 in the mounting direction. Specifically, the locking mechanism 3C includes an opening 31 and an engaging portion 32. The opening 31 is a rectangular opening formed on the upper guide unit left wall 3AL. The engaging portion 32 is a projection projecting leftward from the lower guide unit left wall 3BL. When the lower guide unit 3B is closed upward as shown in FIG. 7, the engaging portion 32 is fitted into the opening 31 while the lower guide unit left wall 3BL around the engaging portion 32 is elastically deformed. The engaging portion 32 comes into contact with a supporting portion 31A (FIG. 7) defining a lower end part of the opening 31 against a biasing force of an unillustrated biasing spring. As a result, the lower guide unit 3B is locked to the upper guide unit 3A. Note that nip pressures of the unillustrated roller pairs arranged on the upper and lower guide units 3A, 3B are stably maintained by arranging the above biasing spring in a compressed manner between the upper and lower guide units 3A, 3B.

Further, the lower guide unit 3B includes a lower guide wall portion 3BS (wall portion), a left projecting portion 33 (projection), a right projecting portion 34 (projection) and the grip portion 35 (projecting piece) (FIG. 5). The lower guide wall portion 3BS is a wall portion on a front side (upstream side in the mounting direction of the sheet cassette 110) of the lower guide unit 3B having a rectangular shape in a top view. The lower guide wall portion 3BS extends along a lateral direction (sheet width direction). The left and right projecting portions 33, 34 are respectively projections projecting downward on left and right end parts (opposite end parts) of the lower guide unit 3B. Note that the left and right projecting portions 33, 34 are front parts of the lower guide unit 3B and arranged behind (downstream side in the mounting direction of the sheet cassette 110) the grip portion 35. The left and right projecting portions 33, 34 come into contact with the aforementioned second left-upper end portion 110L2 and second right-upper end portion 11082 of the sheet cassette 110.

The grip portion 35 is held by a user when the lower guide unit 3B is rotated relative to the upper guide unit 3A. The grip portion 35 is a projecting piece projecting forward (upstream side in the mounting direction of the sheet cassette 110) from the lower guide wall portion 3BS. Note that the locking mechanism 3C is arranged on one end side of the double-sided conveying unit 3 in the sheet width direction and the grip portion 35 is arranged closer to the other end side than the locking mechanism 3C in the sheet width direction. The locking mechanism 3C is disposed closer to the one side than the grip portion 35 in the sheet width direction.

Figure 8:
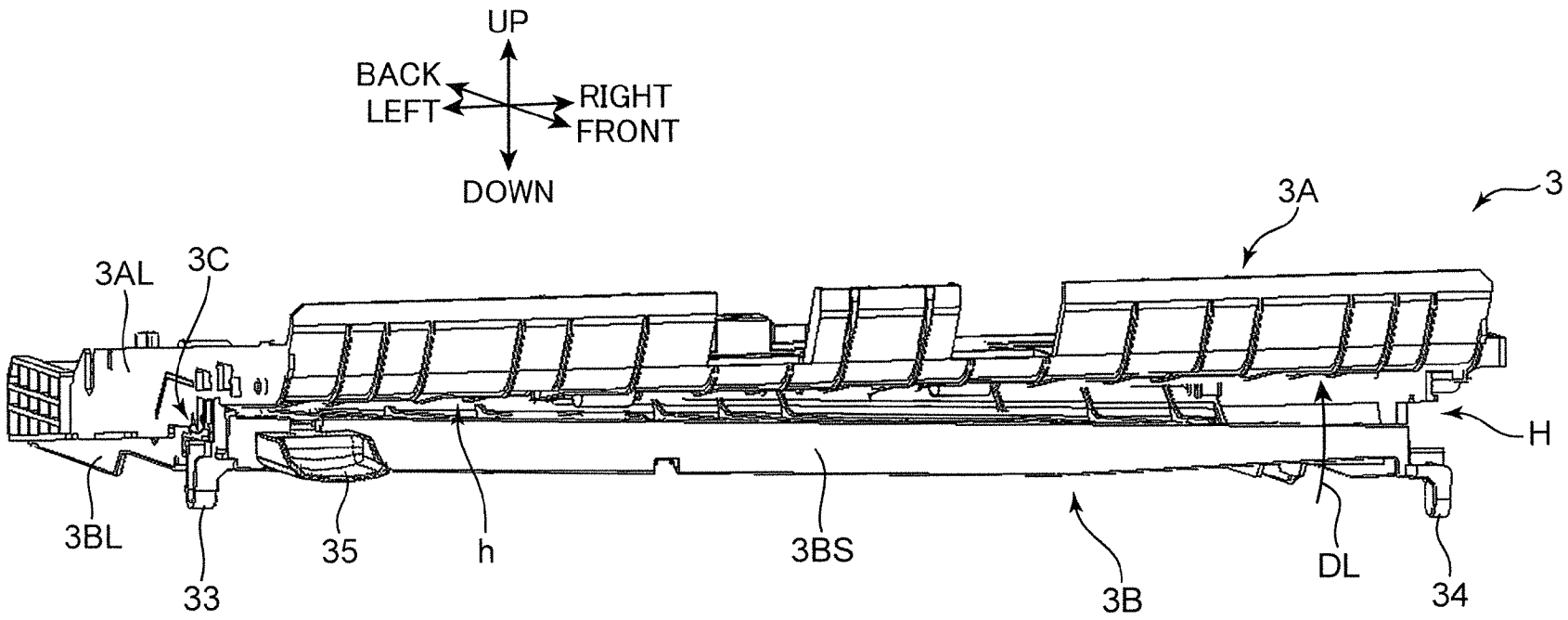
FIG. 8 is a perspective view showing the state where the lower guide unit of the conveying unit according to the one embodiment of the present disclosure is closed.
Figure 9:
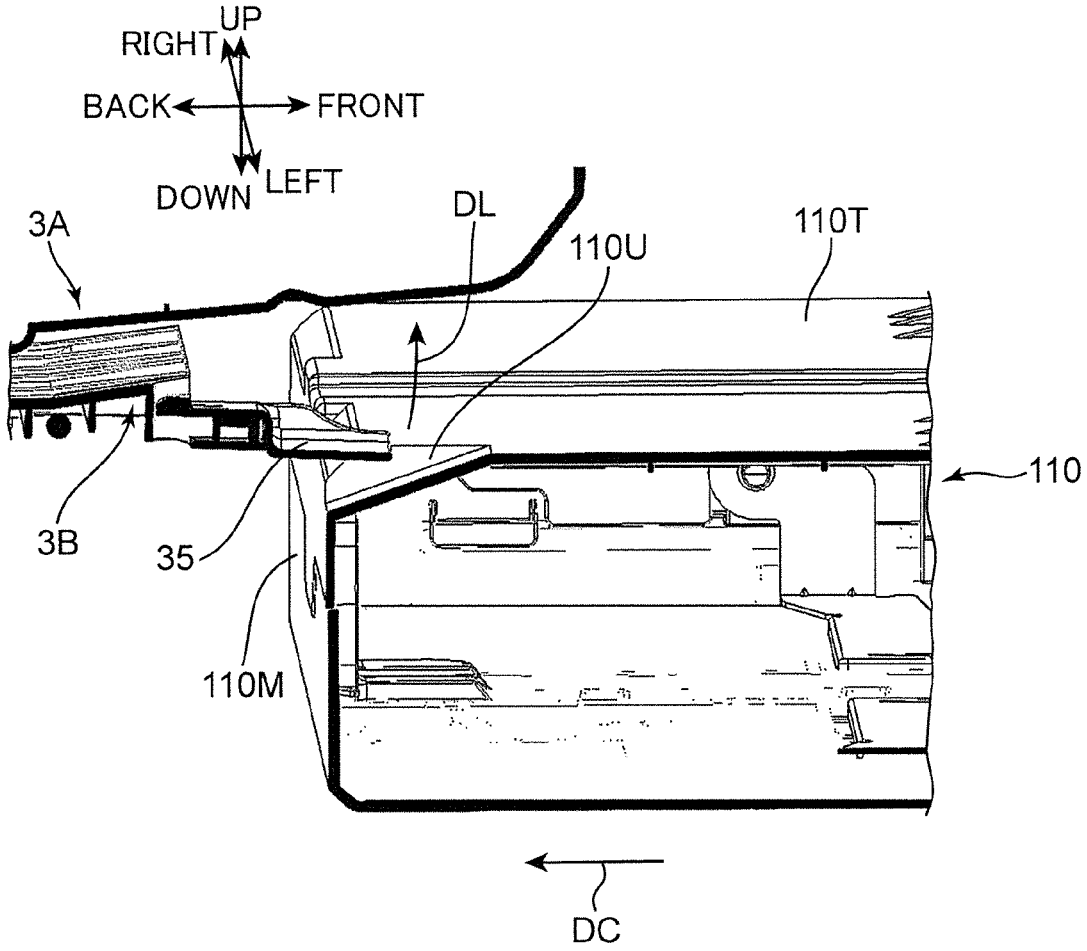
FIG. 9 is a sectional perspective view showing a state of inserting the sheet cassette according to the one embodiment of the present disclosure into an apparatus main body.

FIG. 8 is a perspective view showing a state where the lower guide unit 3B of the double-sided conveying unit 3 according to this embodiment is closed and the locking mechanism 3C is locked (see FIG. 7). Further, FIG. 9 is a sectional perspective view showing a state where the sheet cassette 110 according to this embodiment is inserted into the housing 200. With reference to FIG. 5, in this embodiment, the double-sided conveyance path DP is opened by rotating the lower guide unit 3B of the double-sided conveying unit 3 downward relative to the upper guide unit 3A in a state where the sheet cassette 110 is pulled out from the housing 200. Thus, the user can remove a sheet S jammed in the double-sided conveyance path DP from front. The locking mechanism 3C for locking the lower guide unit 3B to the upper guide unit 3A is arranged on the one end part in the sheet width direction. Therefore, an operation force necessary to lock and unlock the lower guide unit 3B is reduced as compared with the case where the locking mechanism 3C is arranged at each of opposite end parts in the sheet width direction.

On the other hand, when the locking mechanism 3C is arranged only on the left end part of the double-sided conveying unit 3 as just described, an area of the lower guide unit 3B on a side opposite to the locking mechanism 3C in the sheet width direction tends to hang down by its own weight as shown in FIG. 8 even in a state where the lower guide unit 3B is locked to the upper guide unit 3A. Specifically, in FIG. 8, a clearance H between the upper and lower guide units 3A, 3B on the right side of the double-sided conveying unit 3 is larger than a clearance h between the upper and lower guide units 3A, 3B on the left side of the double-sided conveying unit 3. If the sheet cassette 110 is inserted into the mounting portion 100S in this state, the sheet cassette 110 and the lower guide unit 3B may interfere with each other. Particularly, the cassette rear wall 110M (FIG. 3) of the sheet cassette 110 may collide with the lower guide wall portion 3BS of the lower guide unit 3B to break the lower guide unit 3B.

However, in this embodiment, the aforementioned guide surface 110U functions as a push-up portion. With reference to FIG. 9, a tip part of the grip portion 35 first comes into contact with the guide surface 110U when the sheet cassette 110 is mounted into the mounting portion 100S (arrow DC of FIG. 9) with the lower guide unit 3B locked to the upper guide unit 3A. At this time, the grip portion 35 moves upward (arrow DL of FIGS. 8 and 9) along the inclination of the guide surface 110U. As a result, the area of the lower guide unit 3B on the side opposite to the locking mechanism 3C in the sheet width direction is pushed up (arrow DL of FIG. 8). This prevents the cassette rear wall 110M of the sheet cassette 110 from colliding with the lower guide wall portion 3BS of the lower guide unit 3B. Particularly in this embodiment, the push-up portion for pushing up the lower guide unit 3B is arranged on a downstream end part in the mounting direction of the sheet cassette 110. Thus, the lower guide unit 3B can be reliably pushed up in conjunction with the mounting operation of the sheet cassette 110. Note that a clearance 31S is formed on an upper end part of the opening 31 in advance as shown in FIG. 7 so that the lower guide unit 3B is relatively movable upward with respect to the upper guide unit 3A even in the locked state of the locking mechanism 3C.

Further, the grip portion 35 is arranged on a foremost side of the lower guide unit 3B. Thus, the grip portion 35 can be first brought into contact with the sheet cassette 110 in the mounting operation of the sheet cassette 110. Further, since the guide surface 110U is an inclined surface gradually lowered along the mounting direction of the sheet cassette 110, the lower guide unit 3B can be smoothly pushed up by the contact of the grip portion 35 with the guide surface 110U. Further, in this embodiment, the lower guide unit 3B can be pushed up utilizing the grip portion 35 used by the user to operate the lower guide unit 3B.

When the sheet cassette 110 is further inserted into the mounting portion 100S after the lower guide unit 3B is pushed up by the guide surface 110U, the left and right projecting portions 33, 34 eventually come into contact with the second left-upper end portion 110L2 and the second right-upper end portion 11082 while coming into contact with the left inclined portion 110L3 and the right inclined portion 110R3 to be guided. As a result, the lower guide unit 3B is further pushed up and positioned with respect to the upper guide unit 3A in the vertical direction. Thus, the double-sided conveyance path DP can be stably formed between the upper and lower guide units 3A, 3B. As just described, in this embodiment, the lower guide unit 3B can be positioned with respect to the upper guide unit 3A in the vertical direction utilizing the side walls (cassette left wall 110L, cassette right wall 110R) of the sheet cassette 110. Further, since the left and right inclined portions 110L3, 110R3 are formed on the corner parts of the second left-upper end portion 110L2 and the second right-upper end portion 110R2, final positioning of the lower guide unit 3B can be smoothly performed. Furthermore, the lower guide unit 3B can be reliably positioned by the left and right projecting portions 33, 34 projecting downward for positioning from the opposite end parts of the lower guide unit 3B in the sheet width direction.

As described above, in this embodiment, the inclination of the lower guide unit 3B locked by the locking mechanism 3C in the sheet width direction is corrected, as a first stage, in the mounting operation of the sheet cassette 110. Thus, strong collision between the sheet cassette 110 and the lower guide unit 3B is prevented. As a second stage, the positioning of the lower guide unit 3B with respect to the upper guide unit 3A is realized. As a result, the double-sided conveyance path DP of the double-sided conveying unit 3 is stably formed as the sheet cassette 110 is mounted.

Figure 10A:
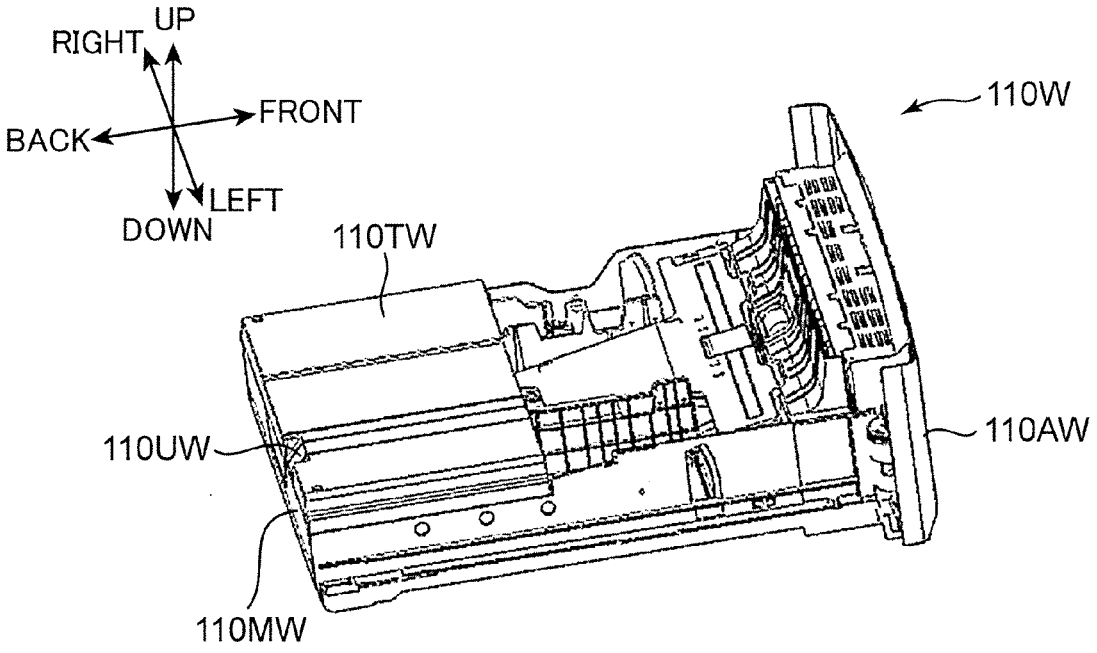
FIGS. 10A and 10B are perspective views of a sheet cassette according to another embodiment of the present disclosure.
Figure 10B:
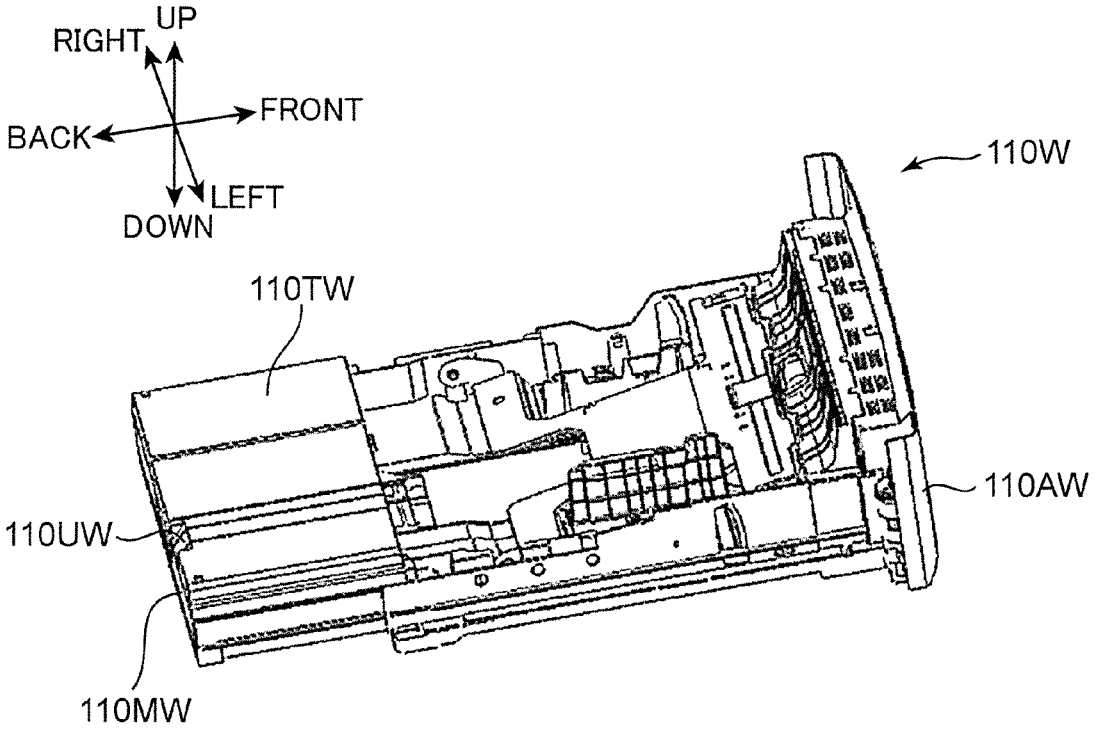
Figure 11:
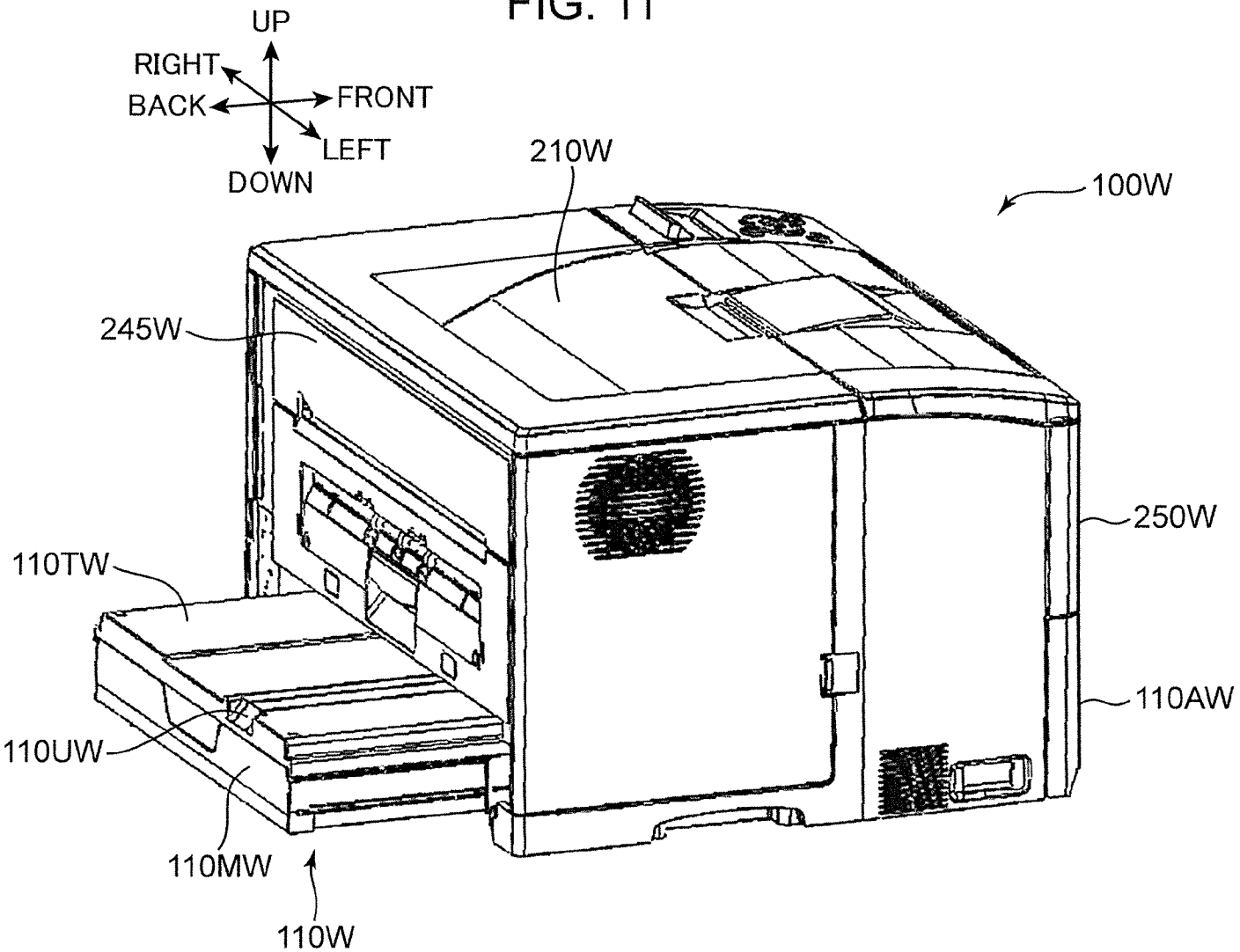
FIG. 11 is a perspective view of an image forming apparatus mounted with a sheet cassette according to a modification of the present disclosure.

FIGS. 10A and 10B are perspective views of a sheet cassette 110W according to a second embodiment of the present disclosure. FIG. 11 is a perspective view of a printer 100W (image forming apparatus) mounted with the sheet cassette 110W. Note that, in FIGS. 10A, 10B and 11, members having structures and functions similar to those of the members according to the previous first embodiment are denoted by reference numbers obtained by adding W in the end of the same reference numbers as in the first embodiment.

As shown in FIGS. 10A and 10B, the sheet cassette 110W has a guide surface 110UW (push-up portion, inclined surface). The guide surface 110UW is formed on a downstream end part of a cassette ceiling plate 110TW of the sheet cassette 110W in a mounting direction. On the other hand, the guide surface 110UW is arranged at a position displaced more rightward than the guide surface 110U according to the previous first embodiment. In this case, an unillustrated projecting piece which can come into contact with the guide surface 110UW is provided to project on an unillustrated double-sided conveying unit arranged in the printer 100W.

In the case of storing sheets S of a size smaller than a predetermined size represented by an A4 size in the sheet cassette 100W, the sheet cassette 110W is mounted in a contracted state of FIG. 10A into the printer 100W. In this case, a cassette front wall 110AW of the sheet cassette 110W becomes a part of a main body front wall 250W (FIG. 11) of the printer 100W and a cassette rear wall 110MW of the sheet cassette 110W becomes a part of a main body rear wall 245W (FIG. 11) of the printer 100W. On the other hand, in the case of storing sheets S of a size not smaller than the predetermined size represented by an A3 size in the sheet cassette 100W, the sheet cassette 110W is mounted in an extended state of FIG. 10B into the printer 100W. In the extended state of the sheet cassette 110W, a bottom part and parts of a pair of side walls of the sheet cassette 100W are slid backward in addition to the cassette rear wall 110MW and the cassette ceiling plate 110TW, whereby an internal space of the sheet cassette 110 is enlarged.

With reference to FIG. 11, when the sheet cassette 110W in the extended state is mounted into the printer 100W, the sheet cassette 110W is mounted into a mounting portion in the printer 100W as in the previous first embodiment. At this time, a tip part of the sheet cassette 110W projects further backward than the main body rear wall 245W after passing through the interior of the printer 100W toward a back side. Then, the cassette ceiling plate 110TW covers a part of the sheet cassette 110W exposed to the outside of the printer 100W from above (FIG. 11). Thus, the entrance of dust and the like into the interior of the sheet cassette 110W is prevented. Note that the sheet cassette 100 and the cassette ceiling plate 110T according to the previous first embodiment also have functions similar to those of the above sheet cassette 100W and the cassette ceiling plate 110TW.

Although the sheet conveying apparatuses and the printers 100, 100W (image forming apparatuses) according to the embodiments of the present disclosure have been described above, the present disclosure is not limited to these and, for example, the following modifications can be adopted.

(1) Although the sheet cassette 110 has the guide surface 110U in the above first embodiment, the present disclosure is not limited to this. The sheet cassette 110 may include another push-up portion shaped differently from the guide surface 110U.

Figure 12:
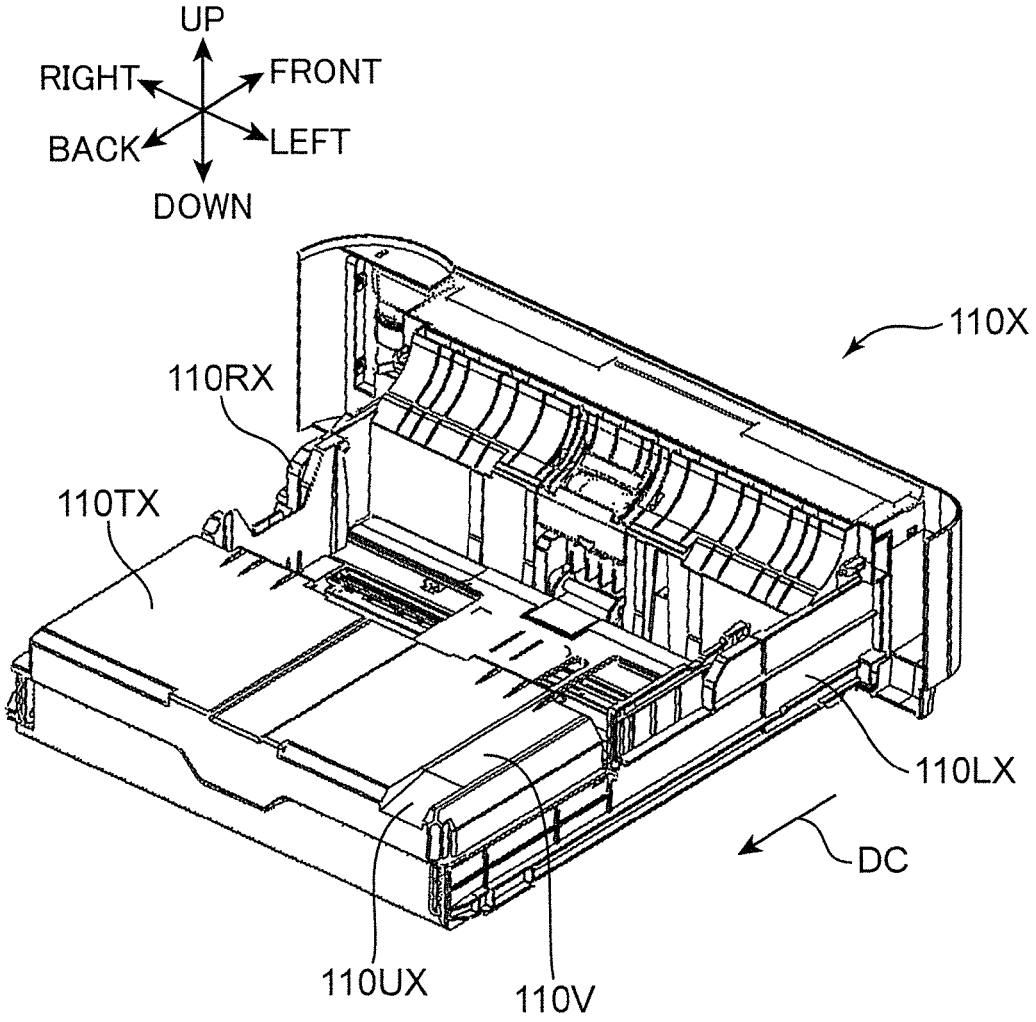
FIG. 12 is a perspective view of a sheet cassette according to another embodiment of the present disclosure.

(2) FIG. 12 is a perspective view of a sheet cassette 110X according to a modification of the present disclosure. Note that, in FIG. 12, members having functions similar to those of the sheet cassette 110 according to the previous embodiment are denoted by reference numbers obtained by adding X in the end of the same reference numbers as in the first embodiment. The sheet cassette 110X includes a guide surface 110UX (push-up portion, inclined surface) and a groove portion 110V arranged on a cassette ceiling plate 110TX. Similarly to the guide surface 110U according to the previous embodiment, the guide surface 110UX functions as a push-up portion for pushing up the grip portion 35 (FIG. 9). The groove portion 110V is a groove portion formed on the cassette ceiling plate 110TX along a mounting direction (arrow DC of FIG. 12) to be continuous with an upstream side of the guide surface 110UX in the mounting direction. A lateral width of the groove portion 110V is set slightly larger than that of the grip portion 35. According to such a configuration, while the sheet cassette 110X is mounted into the mounting portion 100S after the grip portion 35 (FIG. 9) of the lower guide unit 3B comes into contact with the guide surface 110UX to be pushed up, the grip portion 35 moves in the groove portion 110V. At this time, since opposite end parts of the grip portion 35 are restricted by opposite side parts of the groove portion 110V, a movement of the lower guide unit 3B in the sheet width direction can be restricted. In other words, the inclination of the sheet cassette 110X and the lower guide unit 3B with respect to the mounting direction is prevented in a mounting operation of the sheet cassette 110X.

Note that, in the above modification, the cassette ceiling plate 110TX may be arranged to entirely cover a sheet storage of the sheet cassette 110X. In this case, the groove portion 110V extends up to a front end side of the sheet cassette 110X. When the sheet cassette 110X is completely mounted into the housing 200 (FIG. 2), the grip portion 35 is kept engaged with the groove portion 110V. As a result, the position of the lower guide unit 3B in the sheet width direction is restricted in the housing 200, wherefore the skew of a sheet S being conveyed in the double-sided conveyance path DP is prevented. Further, since the lower guide unit 3B is biased upwardly by the sheet cassette 110X via the grip portion 35, downward deflection of the lower guide unit 3B by a pressing force of the pair of conveyor rollers arranged in the double-sided conveying unit 3 is suppressed.

(3) Although the guide surface 110U is formed on the downstream side of the cassette ceiling plate 110T in the mounting direction in the above first embodiment, the present disclosure is not limited to this. In FIG. 9, the cassette rear wall 110M may have a predetermined thickness in the mounting direction of the sheet cassette 110 and another guide surface alternative to the guide surface 110U may be formed on an upper end part of the cassette rear wall 110M.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet conveying apparatus, comprising:

an apparatus main body;

a sheet cassette which includes a storage for storing sheets inside and is mounted into the apparatus main body in a predetermined mounting direction;

a mounting portion which is arranged in the apparatus main body and into which the sheet cassette is mounted; and a conveying unit which is arranged above the sheet cassette in the apparatus main body and conveys the sheet;

wherein:

the conveying unit includes:

a conveyance path in which the sheet is conveyed;

an upper guide unit which defines an upper surface part of the conveyance path and is fixed to the apparatus main body;

a lower guide unit which defines a lower surface part of the conveyance path and enters the mounting portion to open the conveyance path by downward rotation of an upstream side in the mounting direction about a rotation supporting point arranged on a downstream side in the mounting direction; and a locking mechanism which is arranged on one end side of the upstream side in the mounting direction in a sheet width direction intersecting with the mounting direction and locks the lower guide unit to the upper guide unit;

the lower guide unit includes a projecting piece projecting toward the upstream side in the mounting direction, the locking mechanism being disposed closer to the one side than the projecting piece in the sheet width direction; and the sheet cassette includes a push-up portion which pushes up the projecting piece when the sheet cassette is mounted into the mounting portion.

2. A sheet conveying apparatus according to claim 1, wherein:

the sheet cassette includes a ceiling plate arranged above the storage; and the push-up portion is arranged on the ceiling plate of the sheet cassette.

3. A sheet conveying apparatus according to claim 2, wherein:

the lower guide unit includes a wall portion extending along the sheet width direction on the upstream side in the mounting direction;

the projecting piece projects toward the upstream side in the mounting direction from a side of the wall portion closer to the other end side in the sheet width direction than the locking mechanism;

the push-up portion includes an inclined surface arranged to face the projecting piece and formed on a downstream side of the ceiling plate in the mounting direction to be lowered along the mounting direction; and the projecting piece is pushed up by the contact of the projecting piece with the inclined surface when the sheet cassette is mounted into the mounting portion.

4. A sheet conveying apparatus according to claim 3, wherein:

the sheet cassette further includes a groove portion formed on the ceiling plate along the mounting direction to be continuous with an upstream side of the inclined surface in the mounting direction; and a movement of the projecting piece in the sheet width direction is restricted by the groove portion until the sheet cassette is mounted into the mounting portion after the projecting piece comes into contact with the inclined surface.

5. A sheet conveying apparatus according to claim 3, wherein:

the projecting piece is a grip portion to be held when the lower guide unit is rotated relative to the upper guide unit.

6. A sheet conveying apparatus according to claim 3, wherein:

the lower guide unit includes a pair of projections projecting downward from sides of opposite end parts in the sheet width direction downstream of the projecting piece in the mounting direction;

the sheet cassette includes a pair of positioning portions arranged on opposite end parts in the sheet width direction upstream of the inclined surface in the mounting direction; and the lower guide unit is positioned with respect to the upper guide unit in a vertical direction by the contact of the projections with the positioning portions after the projecting piece comes into contact with the inclined surface when the sheet cassette is mounted into the mounting portion.

7. A sheet conveying apparatus according to claim 6, wherein:

the positioning portions are upper end parts of a pair of side walls arranged on the opposite end parts of the sheet cassette in the sheet width direction.

8. A sheet conveying apparatus according to claim 7, wherein:

the side walls have such a step portions as to be lower on a downstream side than on an upstream side in the mounting direction and include inclined portions formed to be lowered along the mounting direction on the corners of the step portions; and the projections come into contact with the upper end parts of the side walls while being guided by the inclined portions until the sheet cassette is mounted into the mounting portion after the projecting piece comes into contact with the inclined surface.

9. An image forming apparatus, comprising:

a sheet conveying apparatus according to claim 1; and an image forming unit which is arranged in the device main body and forms an image on a sheet.

* * * * *